United States Patent [19]

Pfeiffer

[11] Patent Number: 5,000,717

[45] Date of Patent: Mar. 19, 1991

[54] TOY BUILDING COMPONENT

[76] Inventor: Werner B. Pfeiffer, Flat Rock Rd., Cornwall Bridge, Conn. 06754

[21] Appl. No.: 503,245

[22] Filed: Apr. 2, 1990

[51] Int. Cl.[5] ..... A63H 33/10

[52] U.S. Cl. ..... 446/488; 446/85; 40/539; 582/584; 428/542.8; 428/12; 248/174

[58] Field of Search ..... 446/488, 80, 85, 109, 446/388, 387; 40/539, 538, 571, 610; 428/9, 12, 542.8; 248/174; 52/582, 584

[56] References Cited

U.S. PATENT DOCUMENTS

| | | | |
|---|---|---|---|
| 1,028,147 | 6/1912 | Stranders | 446/488 X |
| 1,656,341 | 1/1982 | Smith | 40/539 |
| 4,334,683 | 6/1982 | Campbell | 446/488 X |
| 4,708,691 | 11/1987 | Moore | 446/488 |

FOREIGN PATENT DOCUMENTS

| | | | |
|---|---|---|---|
| 2545371 | 11/1984 | France | 446/488 |

*Primary Examiner*—Mickey Yu

*Attorney, Agent, or Firm*—Dallett Hoopes

[57] ABSTRACT

Component is made from a rectangular sheet of stiffly flexible material and is divided by scoring into a central panel and three end panels on each side, all the panels in a row. The end panels are folded into tubular triangular shapes which overlie the central panel and the vertices of the triangles remote from the central panel are drawn together and held in drawn-together shape by elongate plastic fasteners of U-shape cross-section.

4 Claims, 1 Drawing Sheet

TOY BUILDING COMPONENT

BACKGROUND OF THE INVENTION

1. Field of the Invention

This invention relates to a toy building component made from cardboard having a central panel and end panels. The end panels are shaped into tubes of triangular cross-section and are drawn together so that their vertices remote from the central panel are juxtaposed with adjacent end panels on the two tubes touching, and holding the shape thus produced by elongate plastic elements of U-shape cross-section slipped over the touching end panels of the two triangles.

2. Description of Related Art Including Information Disclosed Under §§1.97 to 1.99

In the prior art there are all sorts of toy building components made from sheet material and folded in ways to make them sturdy and assume various shapes. For instance, the art includes blocks or bricks made from cardboard which is folded to be sturdy and self-supporting.

SUMMARY OF THE INVENTION

The present invention is a novel toy building component which has generally the shape of a pie slice and includes a curved or arcuate central panel and inward radial panels. The component is made from a rectangular sheet divided into seven separate panels delineated by score lines. The central panel is twice as wide as the others and the component is formed by rolling the three end panels on each end of the central panel into a tube of triangular configuration, the tubes each overlying one-half of the central panel. The vertices of the two triangular tubes remote from the central panel are drawn together, and the contiguous sides of the two tubes are held together by plastic fastener elements of U-shape cross-section.

A plurality of the components can be joined together by the plastic fastener elements to make up a cylindrical product.

The components are useful in constructing toy buildings simulating forts or towers or other circular buildings, or other more fanciful shapes.

BRIEF DESCRIPTION OF THE DRAWINGS

Other features and objects of the invention will be apparent from the following specification as well as the drawings, all of which disclose a non-limiting embodiment of the invention. In the drawings.

DESCRIPTION OF THE PREFERRED EMBODIMENT

Figure 1:
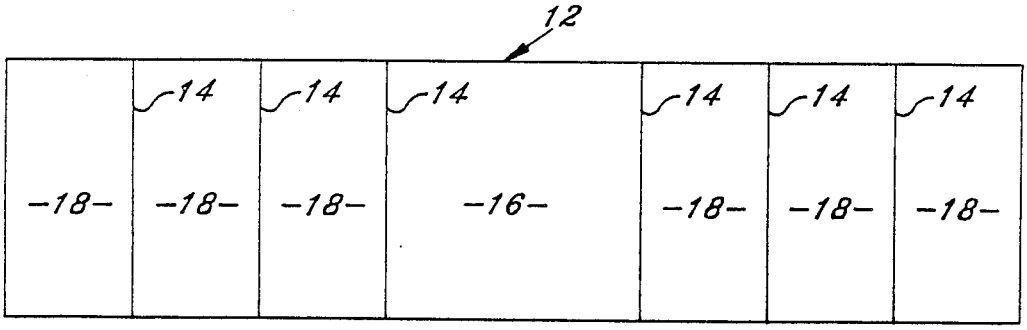
FIG. 1 is a front view of a rectangular sheet from which the component of the invention is made.
Figure 2A:
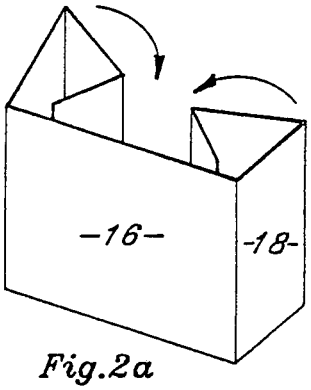
FIGS. 2*a*, 2*b* and 2*c* are progressive views of the construction of the component.
Figure 2B:
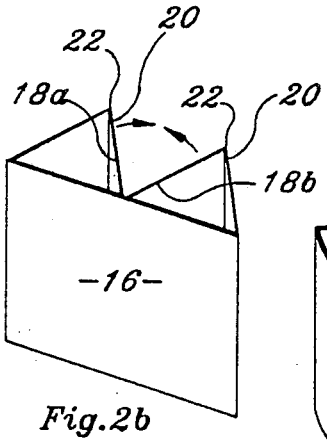
Figure 2C:
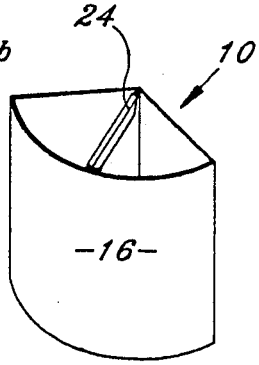

An embodiment of the invention is generally designated 10 in FIG. 2*c*. It is constructed from a rectangular sheet and is designated 12 in FIG. 1. It is divided by parallel linear scoring 14 into seven panels in a row. A central panel 16 is twice as wide as the end panels 18 and all of the end panels are, therefore, of the same width.

The component is created by rolling each of the sets of three end panels into tubes of triangular configuration (FIGS. 2*a*, 2*b*). These two tubes 20 each overlie or are disposed against one-half of the central panel 16. In the next step the two vertices 22 of the triangular tubes, which are most remote from the central panel 16, are drawn together as indicated by the arrow in FIG. 2 so that they touch (FIG. 2*c*). The component is held in this shape by a pair of clip or fastener elements 24 engaging the top and bottom edges of the contiguous or mutually proximate panels 18*a* and 18*b*.

Figure 3:
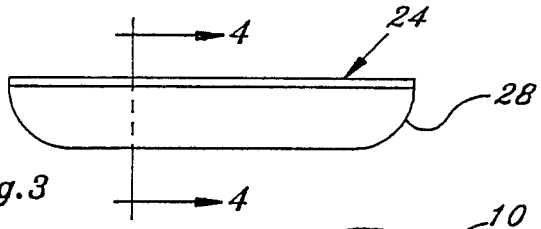
FIG. 3 is an enlarged view of a fastener element used in the component.
Figure 4:
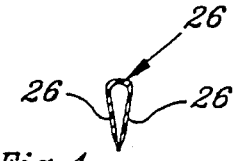
FIG. 4 is sectional view taken on the line 4—4 of FIG. 3.

As shown in FIG. 3, the clip or fastener element 24 is an extruded plastic element which has an inverted U-shaped cross-section (FIG. 4). The distal ends of the legs 26 of the U-shaped element touch and are biased toward each other. As shown, the clips are rounded at each end as at 28, rounded inward toward the midpoint of the element. The clips may be formed from articles known in the stationery trade as "backbones" used in forming file binders and available in various lengths from stationery stores.

In application to the contiguous end panels 18*a* and 18*b*, the clips 24 are angled into one end or the other of the end panels and are pivoted down so that they lie neatly along the edges of the panel, concealing them. Preferably the clips are substantially as long as the end panels 18*a* and 18*b* to give a smooth appearance and also to assure that an end of the clip extends virtually to the vertices 22 to hold the vertices together to make a single vertex for the component.

Figure 7:
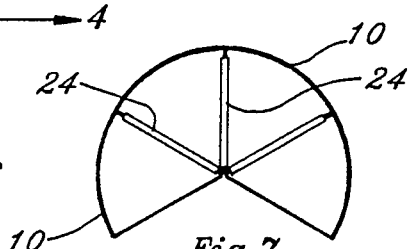
FIG. 7 is a top view of two-thirds of a cylinder made from two components in accordance with the invention.
Figure 5:
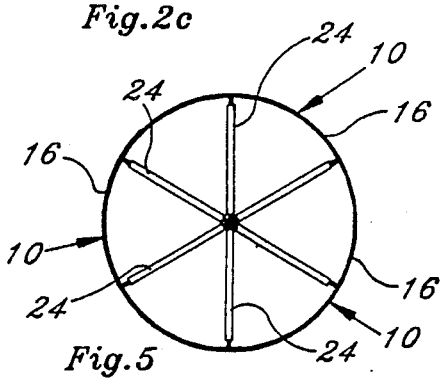
FIG. 5 is a top view of a cylindrical object made from a plurality of the components.
Figure 8:
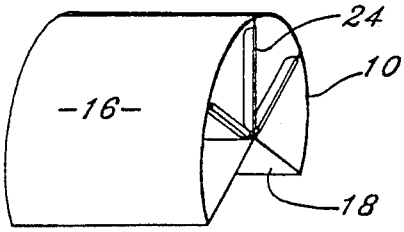
FIG. 8 is a perspective view of the product of FIG. 7 resting on its side.
Figure 6:
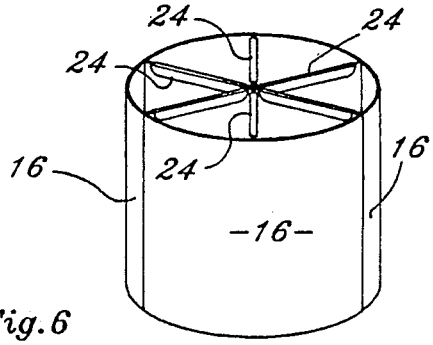
FIG. 6 is a prospective view of the object in FIG. 5.

The versatility of the components made in accordance with the invention is demonstrated in FIGS. 5 through 8 wherein adjacent end panels of two separate components may be clipped together to form either a cylinder as in FIGS. 5 and 6 wherein three of the components are clipped together by clips 24, or, as shown in FIGS. 7 and 8, wherein two components are clipped together by clips 24.

It will be clear to those skilled in the art that the invention provides educational values in that the user must exercise some degree of spacial consideration in developing the component from a flat card. In addition, the card may be printed in such a way that the combined components, each properly assembled, create continuous artistic effects about the periphery of the product. The possibilities for coloring and use of graphics on the faces of the various panels are virtually endless.

Thus, it will be seen that variations within the scope of the invention are possible, the single embodiment disclosed herein merely exemplary. The invention is not so limited but is capable of various adaptation but the invention may be defined as having the scope of the following claim language or reasonable equivalents thereof.

What is claimed is:

1. A toy building component comprising:

(1) A rectangular sheet of thin, stiffly flexible planar stock having top and bottom lengthwise edges and divided lengthwise by parallel linear scoring into seven panels in a row, the central panel being twice as wide as each of the six side panels and each of the six side panels being identical in width, and (2) a plurality of elongate plastic clip fastener elements of closed U-shape in cross-section, comprising legs and a bight, the distal ends of the legs being biased toward each other, the sheet being folded along the scoring so that the three end panels on each end form a tube of triangular cross-section, each tube overlying one-half of the central panel, the vertices of the two tubes remote from the central panel being drawn together and the said vertices and mutually proximate panels adjacent the said verticies respectively being held against each other by the fastener elements hugging together the top and bottom edges of the said mutually proximate panels to result in stress on the central panel to shape it into a curve.

2. A toy building component as claimed in claim 1 wherein the central panel is square.

3. A toy building component as claimed in claim 1 wherein the ends of the fasteners are rounded, curving inward from the bight toward the distal ends of the legs.

4. A toy building component as claimed in claim 1 wherein the fastener elements are each almost as long as the side panels are wide.

* * * * *